US010981283B1

(12) United States Patent
Beets

(10) Patent No.: US 10,981,283 B1
(45) Date of Patent: Apr. 20, 2021

(54) DOUBLE-SIDED BALL SLIDE KNIFE BLADE LOCKING MECHANISM

(71) Applicant: Virgil E. Beets, Lucas, TX (US)

(72) Inventor: Virgil E. Beets, Lucas, TX (US)

(73) Assignee: BladesIIB Machining and Welding Services, LLC, Lucas, TX (US)

( * ) Notice: Subject to any disclaimer, the term of this patent is extended or adjusted under 35 U.S.C. 154(b) by 0 days.

(21) Appl. No.: 17/138,344

(22) Filed: Dec. 30, 2020

Related U.S. Application Data

(60) Provisional application No. 63/113,637, filed on Nov. 13, 2020.

(51) Int. Cl.
*B26B 1/04* (2006.01)

(52) U.S. Cl.
CPC ..... *B26B 1/044* (2013.01); *B26B 1/046* (2013.01); *B26B 1/048* (2013.01)

(58) Field of Classification Search
CPC ..... B26B 1/044; B26B 1/046; B26B 1/048
USPC ..... 30/160, 161
See application file for complete search history.

(56) References Cited

U.S. PATENT DOCUMENTS 2,662,284 A 12/1953 Unsinger
4,451,982 A 6/1984 Collins
5,111,581 A 5/1992 Collins
5,442,855 A 8/1995 Jobin
5,621,973 A * 4/1997 Seber ..... B26B 1/044 30/100
5,822,866 A 10/1998 Pardue
6,289,592 B1 * 9/2001 Emerson ..... B26B 1/044 30/155
6,378,214 B1 4/2002 Onion
6,430,816 B2 8/2002 Neveux
6,490,797 B1 12/2002 Lake et al.
6,553,672 B2 4/2003 Glesser et al.
6,751,868 B2 6/2004 Glesser
6,941,661 B2 9/2005 Frazer
7,062,857 B1 6/2006 Nenadic
7,293,360 B2 11/2007 Steigerwalt et al.
7,578,064 B2 8/2009 Busse
7,979,990 B2 7/2011 Hawk
8,307,555 B2 11/2012 Onion
8,646,184 B2 2/2014 Westerfield
8,813,366 B2 * 8/2014 Chen ..... B26B 1/048 30/160
8,813,368 B2 8/2014 VanHoy
(Continued)

*Primary Examiner* — Hwei-Siu C Payer
(74) *Attorney, Agent, or Firm* — Zachary W. Hilton

(57) ABSTRACT

A knife having a double-sided ball slide knife blade locking mechanism includes a blade pivotally attached to a handle, the blade having a pair of large circular indentations formed on opposite lateral sides of the blade, and also having a pair of small circular indentations formed on opposite lateral sides of the blade. The knife handle has handle scales attached to opposite sides of the knife blade. Each of a pair of detent elements are positioned intermediate the handle scales and knife blade on both sides of the blade, and positioned such that the detent elements will mate with the indentations. Each of a pair of spring-loaded sliding detent release shafts are mounted within the handle scales and have a tapered interior side configured to wedge between the detent element and a detent housing cover to temporarily lock the detent elements in place within the indentations.

20 Claims, 11 Drawing Sheets

(56) References Cited

U.S. PATENT DOCUMENTS

| | | | | |
|---|---|---|---|---|
| 8,966,768 | B2 | 3/2015 | Onion | |
| 9,364,957 | B2 | 6/2016 | Lake | |
| 2006/0174490 | A1 | 8/2006 | Galyean et al. | |
| 2007/0068000 | A1* | 3/2007 | Onion | B26B 1/044 30/160 |
| 2007/0151110 | A1* | 7/2007 | Chen | B26B 1/046 30/155 |
| 2008/0307656 | A1* | 12/2008 | Lin | B26B 1/046 30/159 |
| 2013/0133205 | A1 | 5/2013 | Lo | |
| 2018/0297218 | A1 | 10/2018 | Bruhns | |

* cited by examiner

DOUBLE-SIDED BALL SLIDE KNIFE BLADE LOCKING MECHANISM

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Technical Field

The present invention relates generally to knives, and more specifically, to knife blade locking mechanisms utilizing user-actuated double-sided ball slides (referred to as "detent release shafts" below).

Description of Related Art

Folding knives and automatic knives differ significantly from fixed blade knives in that the blades of such folding or automatic knives are capable of being received in a recess in the handle of the knives. The ability of such knives to receive the blade into the handle is an advantage in that it allows the knife to be stored or carried in a more compact configuration when not in use. Another advantage of such knives is that they are considered to be generally safer when carried or stored because the cutting surface and tip of the knife are not exposed. However, one perceived disadvantage of such folding or automatic knives is that it can be difficult to implement a locking mechanism that will act to safely and consistently lock the blade in the open and/or closed position (in other words, in a position in which the knife blade is exposed or not exposed, respectively). Injuries to the knife user and even bystanders may result if a sufficient blade locking mechanism is not implemented that allows a user to satisfactorily control the rotational movement (in the case of a folding knife) or sliding movement (in the case of an automatic knife) of the knife blade. However, many knife locking mechanisms found in the prior art present drawbacks, either from a safety perspective or from the perspective of introducing disadvantages to other aspects of the knife design. With respect to the drawbacks of prior art knife locking mechanisms relating to safety, some such mechanisms do not provide for sufficient blade "lock up." In other words, such prior art locking mechanisms do not sufficiently arrest the movement of the blade when the blade is in the open position (blade is exposed). With respect to the drawbacks of prior art knife locking mechanisms relating to other aspects of knife design, some locking mechanisms are configured to span across the space between the slabs or "scales" of the knife handle, thereby limiting design options associated with the tang of the knife blade and eliminating the ability to incorporate "flipper tabs" (structure that facilitates opening a folding knife blade) as such tabs would contact structures of the locking mechanism.

Accordingly, what is needed is a knife blade locking mechanism that provides for excellent "lock up" of the blade, nearly eliminating the possibility of unwanted movement of the blade when in the open position. What is also needed is a knife locking mechanism that does not span across the interior handle of the knife, allowing the tang of the knife blade to pass between the knife locking mechanism. What is also needed is a knife locking mechanism that maintains, unlike other prior art locking mechanisms, symmetry on both sides of the knife. These and other needs are met by the embodiments of the knife blade locking mechanism described below with reference to the accompanying drawings.

BRIEF DESCRIPTION OF THE SEVERAL VIEWS OF THE DRAWINGS

The invention will be more fully understood by reference to the following detailed description of the preferred and alternate embodiments when read in conjunction with the accompanying drawings, wherein.

Figure 1:
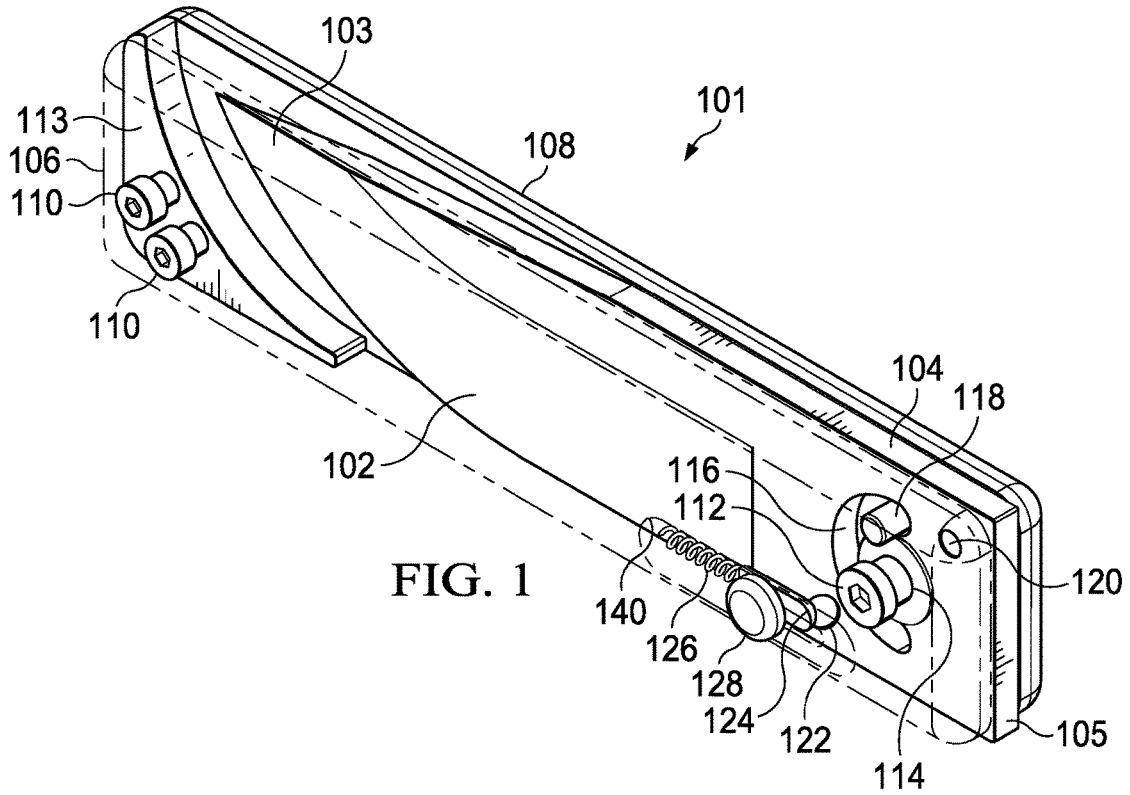
FIG. 1 is a perspective cutaway view of an embodiment of a knife with a blade in a fully closed position, and with one side of the knife handle rendered invisible to reveal a portion of an embodiment of the knife blade locking mechanism.

The above figures are provided for the purpose of illustration and description only, and are not intended to define the limits of the disclosed invention. Use of the same reference number in multiple figures is intended to designate the same or similar parts. Furthermore, if and when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF EMBODIMENTS OF THE INVENTION

Several exemplary embodiments of the claimed invention(s) will now be described with reference to the drawings. Unless otherwise noted, like elements will be identified by identical numbers throughout all figures. The invention(s) illustratively disclosed herein suitably may be practiced in the absence of any element that is not specifically disclosed herein.

A novel double-sided ball slide knife locking mechanism is disclosed herein. It should be noted that while the exemplary embodiments of the inventions as described herein are associated with mechanisms for locking the rotation of knife blades found in folding knives, the same principles discussed herein could be implemented in blade locking mechanism in other types of knives featuring blade opening and closing movement. Indeed, it is contemplated that the knife locking mechanism inventions taught herein could be utilized in connection with various types of automatic knives such as, for example, "switch blade" knives.

Figure 4:
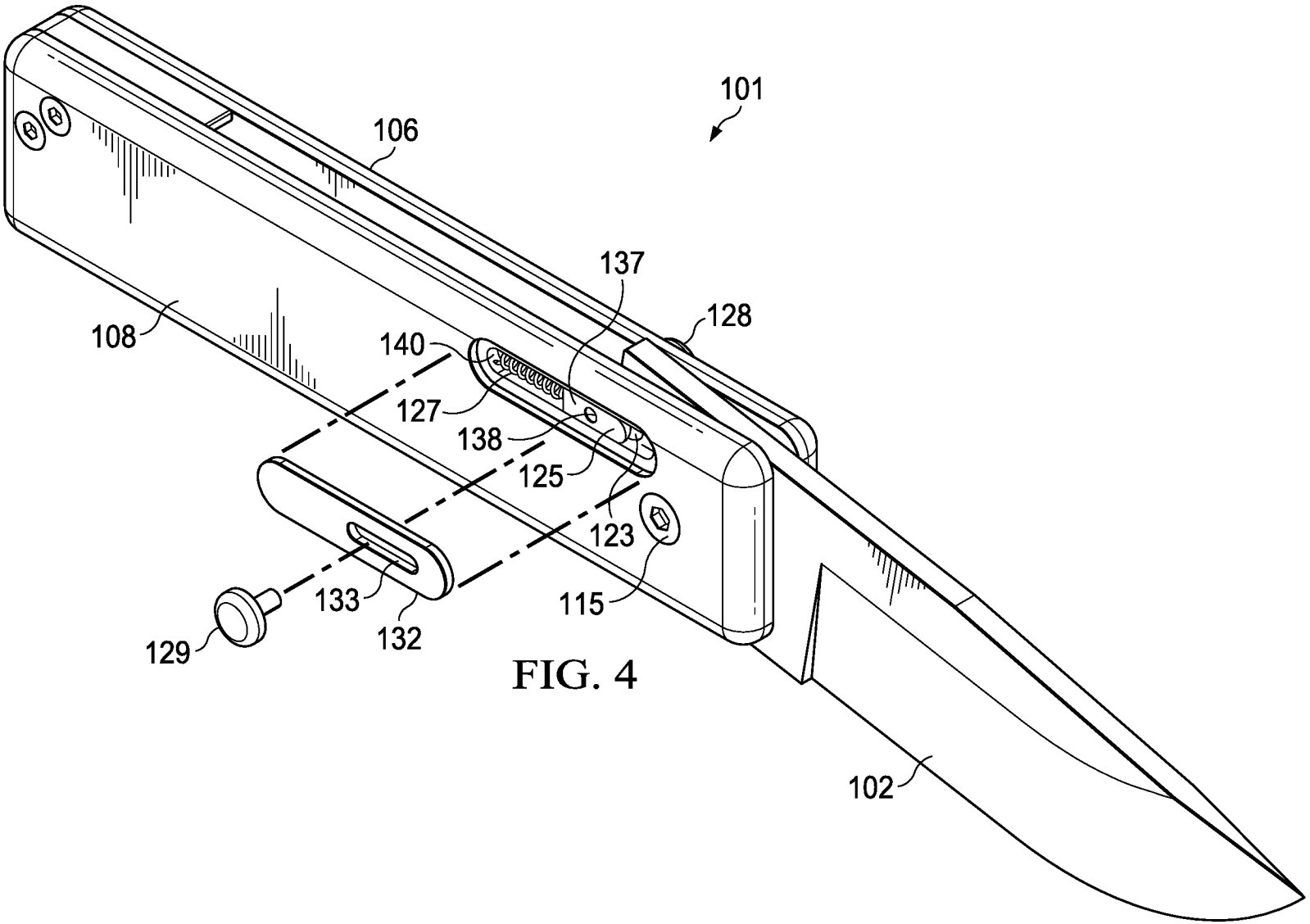
FIG. 4 is a perspective view of an embodiment of the knife depicted in FIG. 1, with the blade in a partially open position, and with a detent housing cover and detent actuator button shown in an exploded view to reveal the spring-loaded sliding detent release shaft of an embodiment of the knife blade locking mechanism.

Referring now to FIG. 1, a perspective cutaway view of an embodiment of a knife (101) with a blade (102) in a fully closed position, and with one side of the knife handle rendered transparent to reveal a portion of an embodiment of the knife blade locking mechanism is shown. A folding knife (101) as depicted in FIG. 1 depicts an embodiment of the knife locking mechanism described and claim herein. Shown in a fully closed position, a distal end (103) of the knife blade, including a knife tip, is safely secured within the knife handle, although all or portions of the top and bottom sides of the knife blade may be visible to a user when stored in such a closed position. The term(s) "distal" or "distally directed" as used herein shall refer to the direction of the tip of the blade of the knife when the blade is in an open position. Conversely, the term(s) "proximal" or "proximally directed" as used herein shall refer to the direction away from the tip of the blade of the knife when the blade is in an open position. The foregoing directional terms shall be used consistently regardless of whether the blade is in an open or closed position. The knife blade includes a proximal portion (104) and a blade tang portion (105), portions of which may also be visible to a user when the blade is in a closed position. Other commonly known features of a folding knife are depicted in FIG. 1, including a first handle scale (106), a second handle scale (108), a first pivot fastener (112) (a second pivot fastener is not shown in FIG. 1, but is depicted in FIG. 4 at 115), one or more handle fasteners (110) used to couple the handle scales together, a handle spacer (113), a stop pin (118), an arcuate slot (116), a pivot aperture (114). Some other commonly known features that may appear in some folding knives are omitted in the figures and descriptions of embodiments of the invention. Those of ordinary skill in the art will recognize that a folding knife may be constructed in various ways, using other components, than that which has been depicted in the figures and described herein. For example, while not shown in the figures, one of ordinary skill in the art would recognize that the knife blade illustrated in the drawings is a front flipper, utilizing the tang (105) of the blade to open the knife, other alternate embodiments may utilize a "kicker" or "flipper" tab or other protrusion positioned on or adjacent to or on the proximal portion (104) or tang (105) to facilitate the ability of a user to open the blade. Moreover, those of ordinary skill in the art will equally recognize that various types of screws, bolts, rivets, pins, etc. may be utilized in a folding knife and need not be discussed in detail here. While some such commonly known features of folding knives are not described or depicted herein, it is contemplated that knives utilizing such features and components may likewise utilize the embodiments of the knife locking mechanisms described herein and fall within the scope of the claims.

Figure 2:
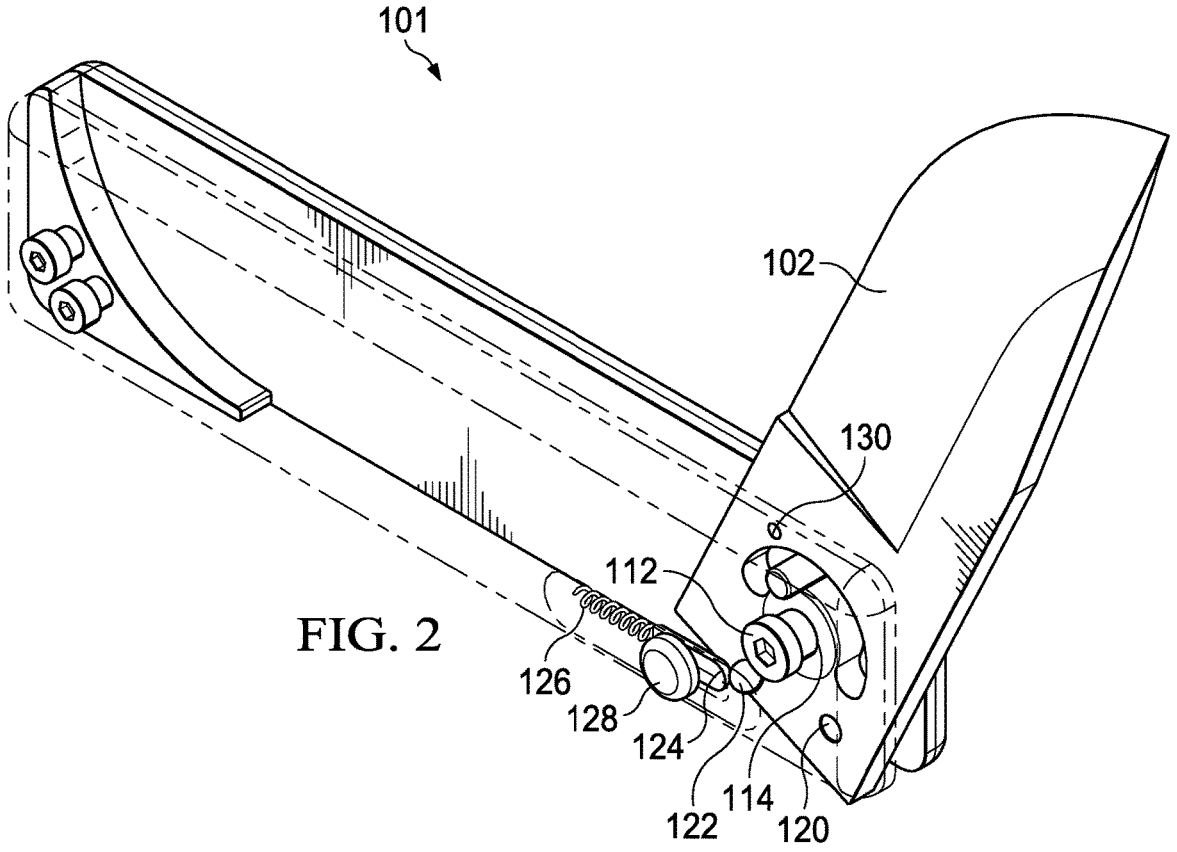
FIG. 2 is a perspective cutaway view of an embodiment of the knife depicted in FIG. 1, with the blade in a partially open position, and with one side of the knife handle rendered invisible to reveal a portion of an embodiment of the knife blade locking mechanism.
Figure 3:
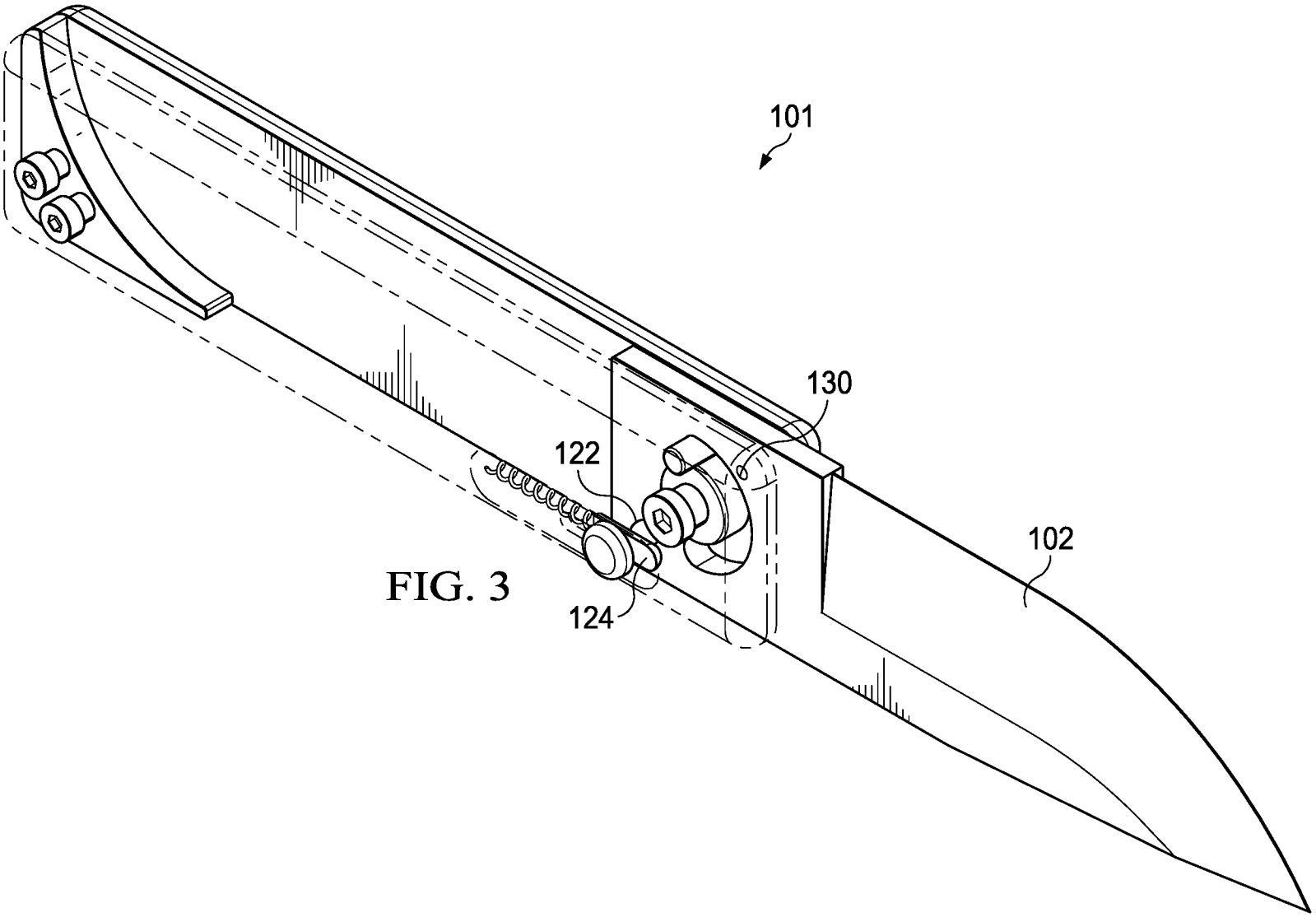
FIG. 3 is a perspective cutaway view of an embodiment of the knife depicted in FIG. 1, with the blade in a fully open position, and with one side of the knife handle rendered invisible to reveal a portion of an embodiment of the knife blade locking mechanism.

Still referring to FIG. 1, in one embodiment of the knife having a novel locking mechanism, a blade is pivotally attached to a handle (in one embodiment, comprised of first and second handle scales) at a pivot aperture via one or more pivot fasteners such that the blade (102), which can be rotated, relative to the handle, between a closed position (shown in FIG. 1) and an open position (shown in FIG. 3). As shown in FIG. 1, and more fully in FIG. 2, the knife blade in one embodiment includes an increased diameter detent indentation (120) and a decreased diameter detent indentation (130) formed on the proximal portion of the blade in addition to the aforementioned pivot aperture also formed on the proximal portion of the blade (also see FIG. 7, which even more fully shows the aforesaid indentations in the knife blade). In the embodiments of the knife blade discussed and shown herein, there is an increased diameter detent indentation formed on both lateral sides of the proximal portion of the knife blade (see FIG. 7), and there is a decreased diameter detent indentation also formed on both lateral sides of the knife blade, with each matching pair of similarly sized detent apertures formed on the directly opposite side of the blade. However, it should be noted that in alternate embodiments, increased diameter detent apertures and decreased diameter detent apertures may be formed as single respective apertures through the lateral sides of the blade on the proximal portion of the blade rather than utilizing the detent indentations discussed herein. It should also be noted that while reference is made herein to the "diameter" of the indentations and apertures, because the indentations depicted in the figures are circular or hemispherical in shape, the indentations and apertures utilized in alternate embodiments may have non-circular or non-hemispherical shapes such that it would be more appropriate to refer to the knife blade as having a first increased/larger sized indentations/aperture and second decreased/smaller sized indentations/aperture formed thereon, referring to the size of the openings to the indentations or apertures in the knife blade.

Still referring to FIG. 1, in one embodiment a first detent element (122) and second detent element (not depicted in FIG. 1, but see FIG. 8 at 123), positioned on opposite lateral sides of the knife blade, intermediate the lateral sides of the knife blade and the respective interior sides of the handle scales, and are configured to removably mate with the aforementioned respective increased diameter detent indentations (120) formed on opposite lateral sides of the knife blade, so as to prevent rotation of the knife blade and at least temporarily lock the knife blade in a fully open position such as is depicted in FIG. 3. The first detent element (122) and second detent element (not depicted in FIG. 1, but see FIG. 8 at 123), positioned on opposite lateral sides of the knife blade, are also configured to removably mate with the aforementioned respective decreased diameter detent indentations (130) formed on opposite lateral sides of the knife blade, so as to provide resistance to rotation of the knife blade in the closed position such as is depicted in FIG. 1. Likewise, while the detent elements described and shown herein are spherically shaped balls (for example, stainless steel ball bearings), detent elements utilized in alternate embodiments may have different shapes that are configured to mate with correspondingly shaped indentations or apertures formed on the knife blade used in such alternate embodiments. As noted above, the blade locking mechanisms taught herein may be implemented in connection with automatic knives such as switch blade knives. In such alternate embodiments implemented in automatic knives, it is contemplated that a second increased diameter detent indentation would be positioned at the location of the decreased diameter detent indentation (in other words, substituting an increased diameter detent indentations for the decreased diameter detent indentations found on both side of the blade of the folding knife). The use of a second increased diameter detent indentation on the blade of the knife would permit for locking of the blade in the closed position in the manner discussed herein for locking the blade in the open position. First and second increased diameter detent apertures formed through the knife blade may also be used in connection with such alternate embodiments instead of detent indentations.

Still referring to FIG. 1, a first spring-loaded sliding detent release shaft (124) is secured within a slot (140) within the first handle scale (106), the detent release shaft being able to slide in a proximal and distal direction within such slot. In one embodiment, a detent actuator button or lever (128) is fastened to (or formed integrally with the detent release shaft in alternate embodiments) an exterior side of the detent release shaft, allowing a user to control the sliding movement of the detent release shaft within the slot. A coiled spring (126) is mounted within the slot (140) proximally with respect to the detent release shaft, and provides a distally directed spring biasing force on the proximal end of the detent release shaft. In alternate embodiments, a loop spring may be utilized to provide such spring biasing force on the detent release shaft. As further described in more detail below, both the spring and force applied by a user on the detent actuator button assist in sliding the detent release shaft proximally and distally to move the detent release shaft with respect to the detent elements such that an interior tapered side of the detent release shaft engages and wedges between a respective detent element and detent housing cover to arrest rotational movement in the open blade position (shown in FIG. 3), by completely covering and blocking the detent, or to resist rotational movement in the closed blade position (shown in FIG. 1) by providing spring pressure against the detent element.

Figure 8:
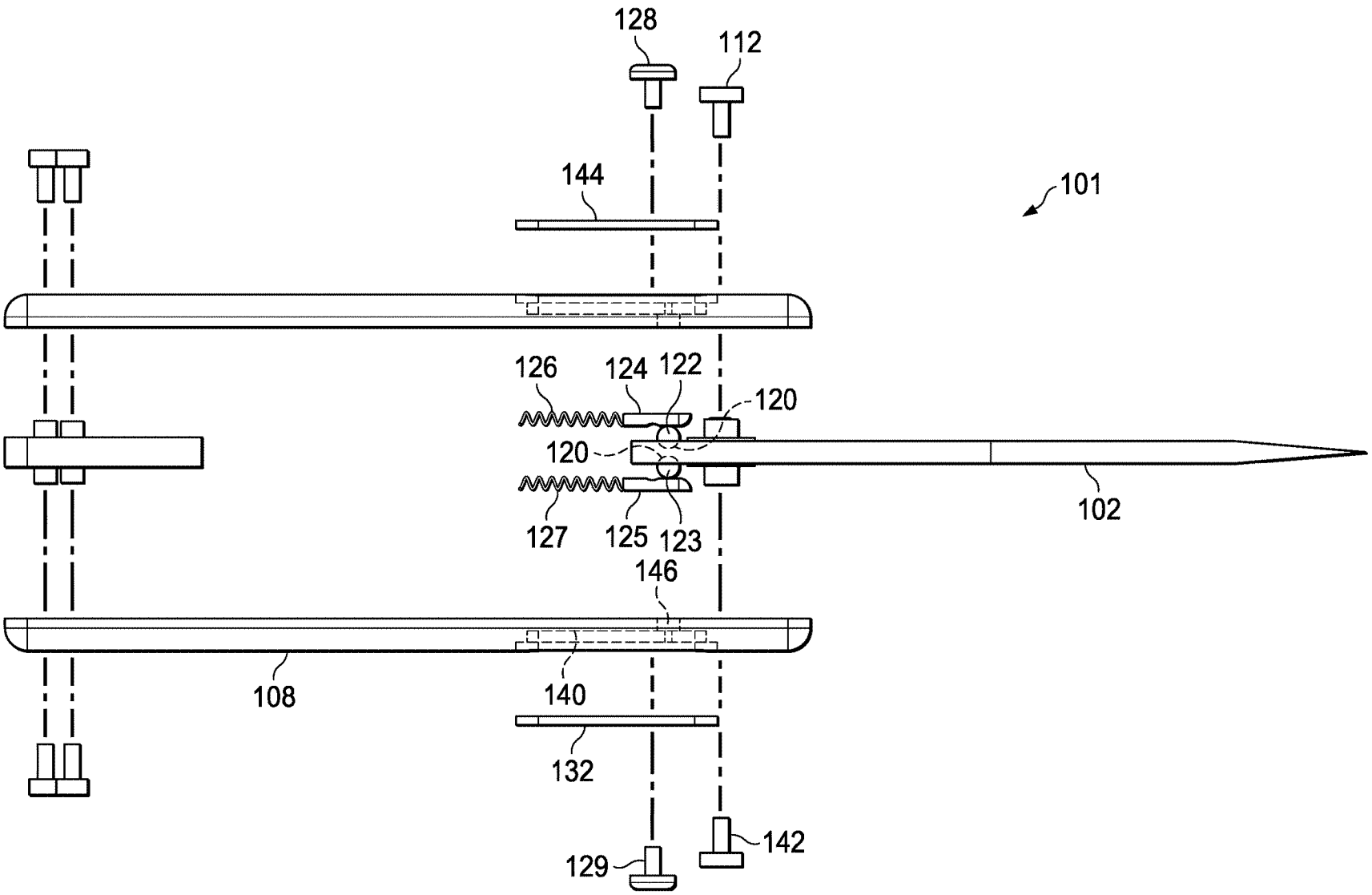
FIG. 8 is a top exploded view of the embodiment of the knife depicted in FIG. 1, having the knife blade in the fully open position.
Figure 9:
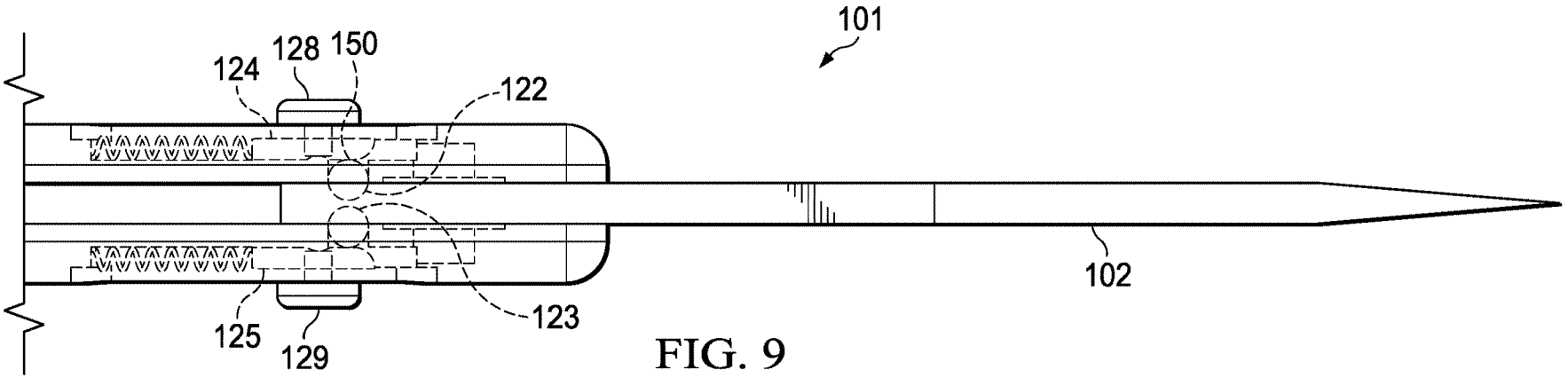
FIG. 9 is a top view of the embodiment of the knife depicted in FIG. 1, having the knife blade in the fully open position, with internal components or structures of the knife blade locking mechanism obscured by the knife handles or knife blade depicted using broken lines.
Figure 10:
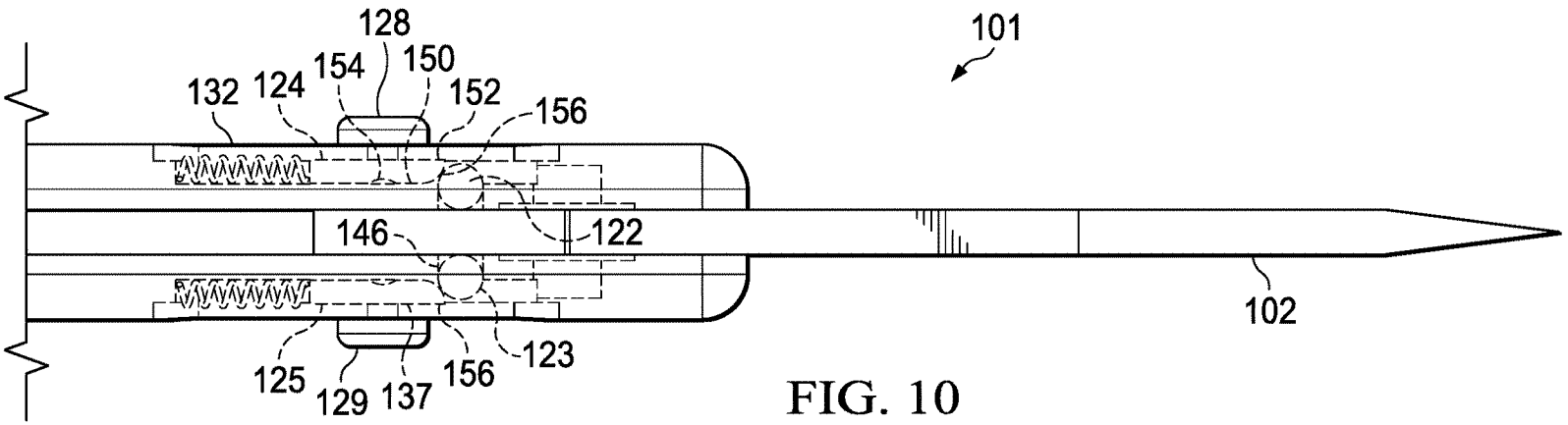
FIG. 10 is a top view of the embodiment of the knife depicted in FIG. 1, having the knife blade in a partially closed position, with internal components or structures of the knife blade locking mechanism obscured by the knife handles or knife blade depicted using broken lines.

Critical to understanding the invention described herein is to recognize that the components of the knife locking mechanism are utilized on both lateral sides of the knife blade. As depicted in FIGS. 8-10, each of the detent element, detent release shaft, spring, slot formed in the handle scale, and detent actuator button (as well as other structural components of the handle scales) have an identical component or structure utilized on the opposite lateral side of the knife. Likewise, and as alluded to above, the increased and decreased detent indentations described herein are formed on both sides of the knife blade, except with respect to alternate embodiments utilizing a pair of apertures formed fully through knife blade as discussed above. One advantage of the blade locking mechanism described herein is that it provides a mechanical blade lock that is improved over prior art locking mechanisms due to the fact that the detent elements mate with indentations/apertures on both sides of the knife blade, and does so in a way that allows the tang of the blade to pass between the detent elements on both sides of the blade. This feature in the blade locking mechanism allows for greater latitude in choosing blade and blade tang options that are not available with knives utilizing prior art blade locking mechanisms that span across the space between the handle scales.

Referring now to FIG. 2, a perspective cutaway view of an embodiment of the knife (101) depicted in FIG. 1, with the knife blade (102) in a partially open position, and with one side of the knife handle rendered invisible to reveal a portion of an embodiment of the knife blade locking mechanism is shown. As the knife blade rotates about the pivot aperture (114) and pivot fastener (112), moving from a closed blade position to an open blade position, the spherical detent element (122) is disengaged from the detent indentations and in one embodiment, may slide into a matching diameter notch or hole or recess formed laterally into the knife handle scale such that the detent element can move freely between the increased/decreased diameter detent indentations formed in the blade and the sliding detent release shaft (124). During such rotational movement of the knife blade, only a distal ball nose portion (see FIG. 10 at 156; and also see FIG. 12 at 156) of the interior side (see FIG. 10 at 154; and also see FIG. 12 at 154) of the detent release shaft (side of detent release shaft facing knife blade) is in contact with the detent element if under spring pressure, or the detent release shaft is not in contact with the detent element at all if the detent actuator buttons are held back by the user (in other words, if the user opposes the spring pressure). It is unnecessary for a user to apply force or to even touch the detent actuator button (128) as the blade transitions from a closed to open position. When the knife blade is in a closed position, the detent element (122) makes contact with the ball nose (see FIG. 11 and FIG. 12 at 156) of the detent release shaft (124) and this ball on ball contact is what allows the blade to be forced open via a flipper tab or other pressure without having to engage the detent actuator buttons, the detent element (122) is able to move the detent release shaft (124) on its own when in the decreased diameter indentation (130). While between an open blade position and a closed blade position, this same ball on ball contact (detent element (122) and ball nose of detent release shaft (124)) is what keeps even pressure on the detent elements on both sides of the blade creating just a little friction as the blade moves. This pressure is constant through the whole movement between the blade increased/decreased diameter detent indentations (120 & 130). This friction is not enough to impede flipper action and is only noticed during closing of the blade, when the pressure is just enough to hold the blade and keep it from swinging totally free. When the blade reaches a fully open position, then the spring (126) keeping the steady ball on ball pressure (detent element (122) and ball nose of detent release shaft (124)) is able to push the detent element fully into the increased diameter detent indentation (120) and because this indentation has a larger diameter opening and the detent (122) goes into the indentation to a greater depth, the spring (126) is able to push the tapered interior side of the detent release shaft (124) completely over the detent element (122). The detent release shaft is tapered from the ball nose to approximately the middle point of the length of the detent release shaft (increasing in thickness), and this taper is what allows the detent release shaft (124) to move securely between the detent (122) and the detent housing cover (see FIG. 4 at 132) forming a wedge. This wedge action, in addition to completely covering the detent with the detent release shaft makes the secure blade lock up and prevents the detent elements from having any movement in the detent indentations, thereby arresting (lock) rotational movement of the knife blade in the open blade position.

Referring now to FIG. 3, a perspective cutaway view of an embodiment of the knife (101) depicted in FIG. 1, with the blade (102) in a fully open position, and with one side of the knife handle rendered invisible to reveal a portion of an embodiment of the knife blade locking mechanism is shown. When the knife has rotated into the fully open position, the interior surface (side facing the blade) of the detent element (122) mates with increased diameter detent indentation (not visible in FIG. 3) formed on the lateral side of the proximal portion of the knife blade. In this fully open position, the spring applies a distally directed biasing force on the detent release shaft, causing the detent release shaft to slide distally in the handle scale slot until the tapered portion formed on the interior side of the detent release shaft wedges between the exterior surface (side facing away from the blade) of the detent element and the interior surface of the detent housing cover (see FIG. 4 at 132). In this manner, the detent element arrests rotational movement of the blade when in the open position, and the detent release shaft prevents the detent element from moving away from the blade, either in an exterior directed direction away from the blade, or in a proximally or distally directed direction. The utilization of the aforementioned knife locking mechanism on opposite lateral sides of the knife provides optimal locking force to prevent blade rotation when in the open position. Such increased locking force provides for increased safety for users of knives that incorporate such a locking mechanism and, as discussed above, provides the designers of such knives with significantly greater latitude in selecting blade and blade tang designs as the novel locking mechanism herein does not rely upon locking structures that span the width of the knife handle or otherwise impede rotational movement other than as described herein.

Referring to now FIG. 4, a perspective view of an embodiment of the knife depicted in FIG. 1, with the blade in a partially open position, and with a detent housing cover (132) and detent actuator button (129) shown in an exploded view to reveal the spring-loaded detent release shaft (125) of an embodiment of the knife blade locking mechanism is shown. It should be recognized that the knife (101) depicted in FIG. 4 is oriented such that the opposite side of the knife that was not visible to the reader in FIGS. 1-3 is now visible to the reader. The reader should note that various components of the knife appearing in FIG. 4 have been labeled with reference numbers different than those used in FIGS. 1-3. This change in numbering is merely intended to indicate that different components are being used on the opposite side of the knife, even though such components are identical to the components used on the opposite side of the knife that appeared in FIGS. 1-3. A slot (140) is formed on the exterior side of each of the two handle scales and is configured to hold the spring (127) and detent release shaft (125) captive inside the handle of the knife, while allowing for sliding movement in a proximal and distal direction. In one embodiment, the spring (127) is not attached to the detent release shaft (125) or to the slot, but instead the distal end of the spring abuts the proximal end (137) of the detent release shaft, and the proximal end of the spring abuts the proximal end of the slot. However, it is recognized that in alternate embodiments, the distal end of the spring may be attached or fastened to the detent release shaft and/or the proximal end of the spring may be attached or fastened to the slot.

Still referring to now FIG. 4, in one embodiment, a detent housing cover (132) is shaped to cover an exterior opening of the handle scale that leads to the slot (140) that houses the spring and detent release shaft. In one embodiment, the detent housing cover may be removable from the handle scale via fasteners, but in other embodiments, may be integrally formed as part of the handle scale. Indeed, in some alternate embodiments, the detent housing cover may not exist as a separate component of the knife, but rather the handle scale itself may be formed to cover the slot. In even other alternate embodiments, a portion of the interior side of the handle scale may be removable to access the slot and/or other components utilized in the knife locking mechanism. In such alternate, embodiments, the knife may further comprises a cartridge containing the detent element and the slot, wherein the cartridge is configured to be inserted into a slot formed on an interior side of the handle scale, and wherein a notch/hole/recess is formed on an interior side of the cartridge, said notch/hole/recess being configured to receive at least half of an exterior side of the detent element. Referring again to FIG. 4, the detent housing cover includes a slot through which a shaft of the detent actuator button (129) passes to attach to a hole (138) formed on the exterior side of the detent release shaft. In one embodiment the detent actuator button is removably fastened to the detent release shaft via a threaded shaft that mates with a correspondingly threaded hole (138) in the detent release shaft. However, in other alternate embodiments, the detent actuator button may be integrally formed with the detent release shaft, especially in configurations of the knife not utilizing a detent housing cover. The detent actuator button (128) attached to the opposite side of the knife is visible in FIG. 4. The reader should recognize that while the detent actuator element described and shown herein is referred to as a "button," alternate embodiments may utilize other types of detent actuator elements such as, for example, a lever, tab, or any other structure, having any other shape, that would enable a user to slide the detent release shaft in a proximal direction so as to disengage the detent release shaft from the detent element to allow for rotational movement of the knife blade. It is contemplated that a user would utilize the detent actuator elements attached on both sides of the knife, substantially simultaneously, to move the respective detent release shafts attached to such detent actuator elements in a proximal direction, to disengage the detent release shafts from being wedged between the exterior surfaces of the respective detent elements on both sides of the knife blades and the corresponding detent housing covers, thus allowing for rotational movement towards the closed blade position (unlocking the knife blade). When the detent release shafts are pulled in a proximal direction by the user, the detent elements are free to move in their respective matching hole or notch or recess (see FIG. 10 at 146) between the blade and the detent release shaft, which allows the blade to easily push the detent elements out of the way and swing towards the closed blade position.

Figure 5:
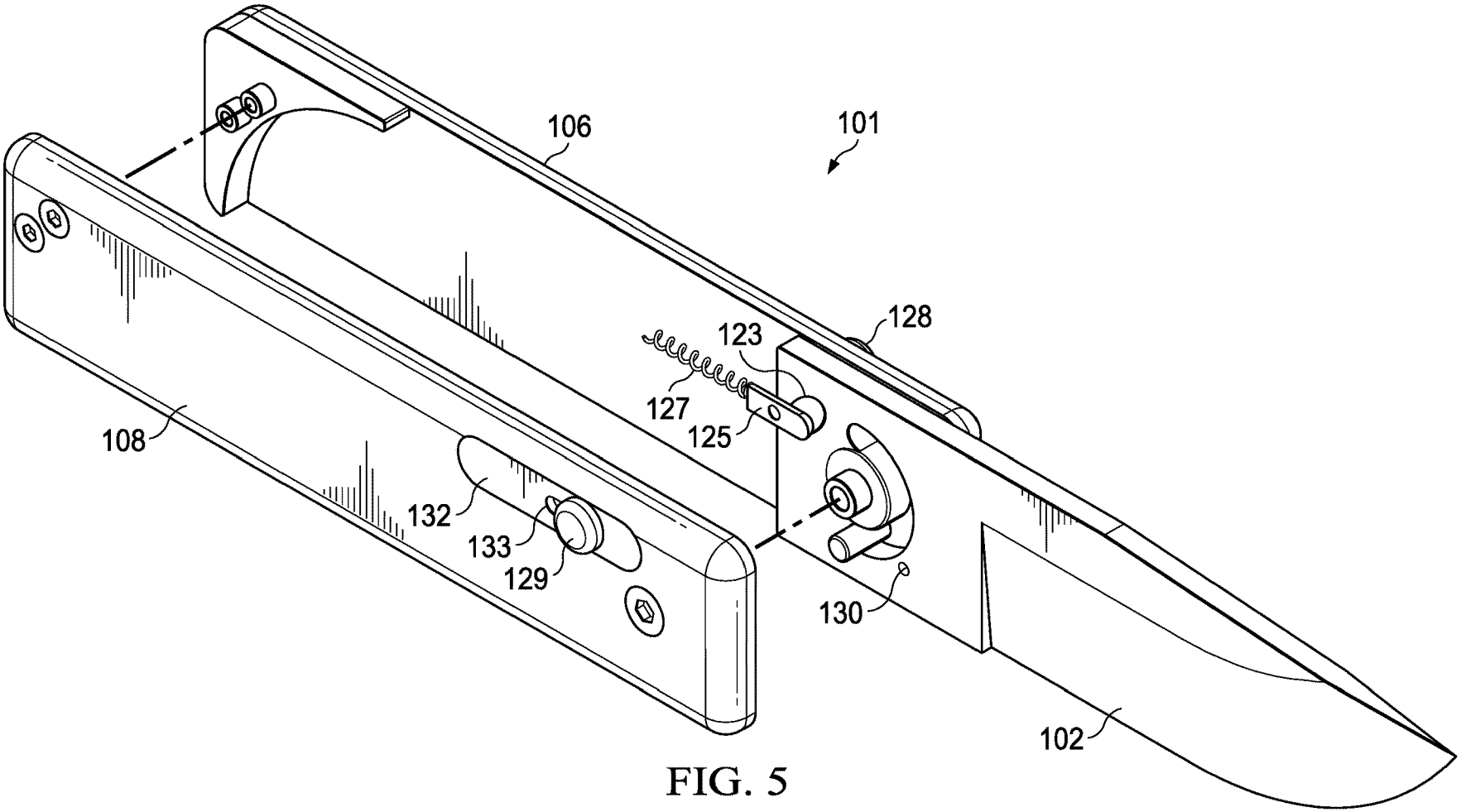
FIG. 5 is a partially exploded view of an embodiment of the knife depicted in FIG. 1, with the blade in a fully open position, and with one side of the knife handle shown in an exploded view to reveal a portion of an embodiment of the knife blade locking mechanism.

Referring now to FIG. 5, a partially exploded view of an embodiment of the knife (101) depicted in FIG. 1, with the blade (102) in a fully open position, and with one side of the knife handle scale (108) shown in an exploded view to reveal a portion of an embodiment of the knife blade locking mechanism is shown. In one embodiment, when the blade is in the fully open position, the detent release shaft slides distally, pushing the detent into the increased diameter detent indentation until the taper formed on its interior side wedges between the rounded exterior surface of the detent element which, in the embodiment depicted herein, is a spherically shaped ball such as a metal ball bearing, and detent housing cover. Only a portion of the exterior surface of the detent element mates with the detent release shaft, and only a portion of the interior surface of the detent element mates with the increased diameter detent indentation formed on the knife blade. When the blade is in the open position, the user can utilize the detent actuator buttons/levers (129, 128) to unlock the blade, sliding the buttons in a proximal direction. The detent release shafts, being attached to the detent actuator buttons, are also moved proximally such that they disengage the detent release shafts from being wedged between the exterior surfaces of the respective detent elements on both sides of the knife blades and the corresponding detent housing covers (132), which in turn permits the de-mating of the detent elements from the respective increased diameter detent indentations formed on the knife blade, the detents are now free to move in their matching size hole or notch between the blade and the detent release shaft, this allows the blade to easily push them out of the way, thereby unlocking the blade and allowing for rotational movement back towards the closed blade position. When in the closed blade position, the detent element (123) mates with the decreased diameter detent indentation (130, not visible in FIG. 6) to resist, but not arrest, rotational movement of the blade. In one embodiment, the diameter of the detent element is approximately 0.125 inches, the diameter of the opening to the increased diameter detent indentation is 0.109 inches, the diameter of the opening to the decreased diameter detent indentation is 0.0625 inches, and the taper on the detent release shaft to form the wedge is approximately 0.010 inches. However, the reader will recognize that the detent element and the detent indentations (or apertures), as well as the taper formed on the interior side of the detent release shaft, may be constructed to have various sizes so as to allow for differing dimensions in knives and knife blades.

Figure 6:
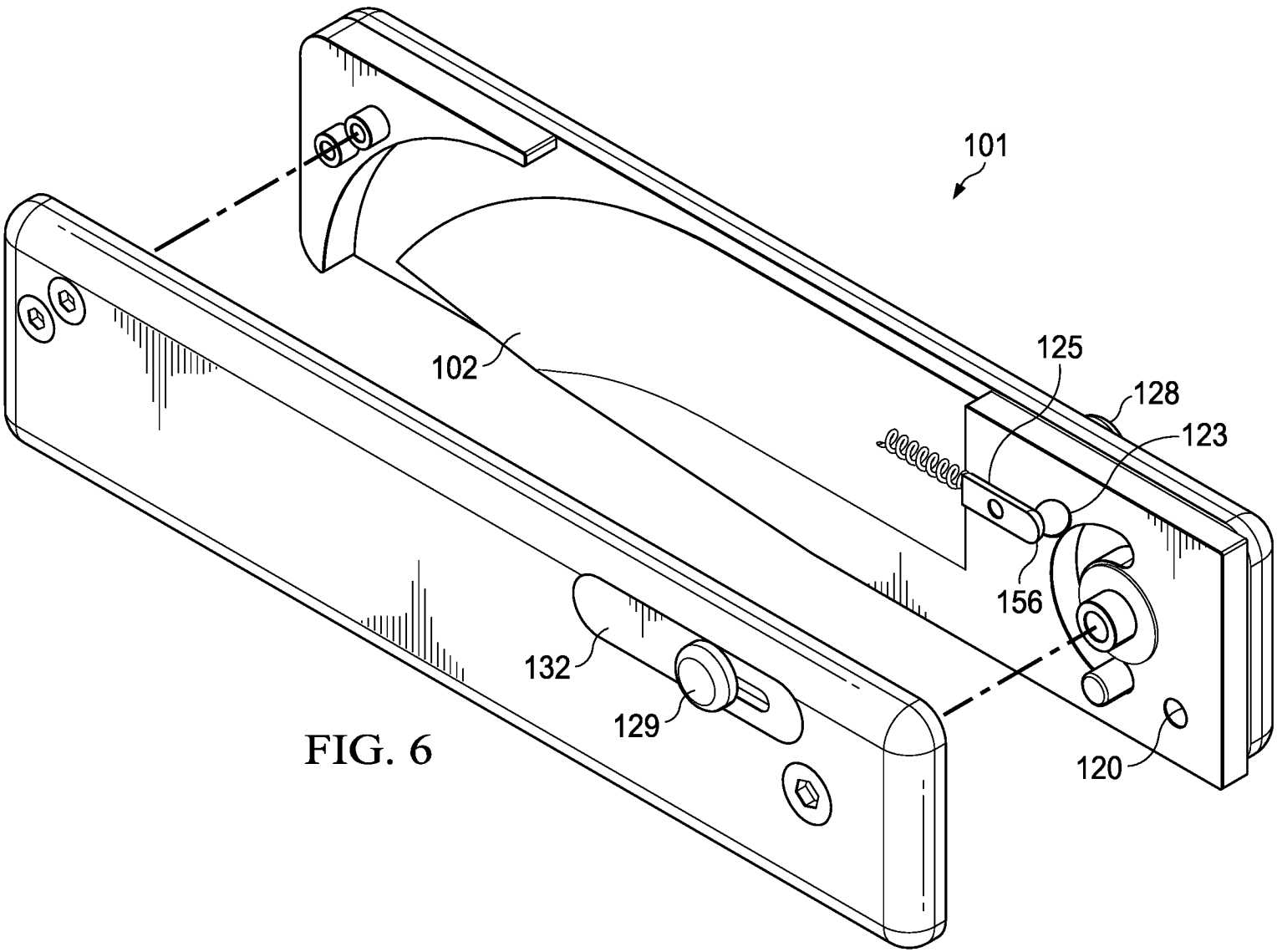
FIG. 6 is a partially exploded view of an embodiment of the knife depicted in FIG. 1, with the blade in a fully closed position, and with one side of the knife handle shown in an exploded view to reveal a portion of an embodiment of the knife blade locking mechanism.

Referring now to FIG. 6, a partially exploded view of an embodiment of the knife (101) depicted in FIG. 1, with the blade (102) in a fully closed position, and with one side of the knife handle shown in an exploded view to reveal a portion of an embodiment of the knife blade locking mechanism is shown. In the blade position shown in FIG. 6, only the ball nose (156) on the distal end of the interior side of the detent release shaft contacts the detent element. The detent elements in this position will not move into the decreased diameter detent indentations to a depth that would allow the detent release shafts to move fully into the distal position. In other words, in this closed blade position, the tapered interior sides of the detent release shafts will not move over to engage or mate with the exterior surfaces of the respective detent elements and cannot cover the detent element or form the wedge action between the detent element and the detent housing cover. This lack of engagement in the closed position permits the opening of the knife via flipper or thumb stud without the user having to pull back the detent actuator buttons as is required to release the detent elements when the user unlocks the locked knife in the open blade position. However, in alternate embodiments, the decreased diameter indentations in the blade may be constructed to have an increased diameter that would allow for such engagement by the detent release shafts, resulting in a locked blade in the closed position. The smaller the diameter of the opening of the decreased diameter detent indentation, the detent element has less ability to resist rotational movement of the blade such that a user can relatively easily overcome such rotational resistance to disengage (or de-mate) the detent element from the decreased diameter detent indentation. Once a threshold resistance is reached, leading to the disengagement of the detent element from the decreased diameter detent indentation, very little blade rotational resistance is experienced by the user, or no rotational resistance is experienced by the user if the detent actuator buttons are held back by the user.

Figure 7:
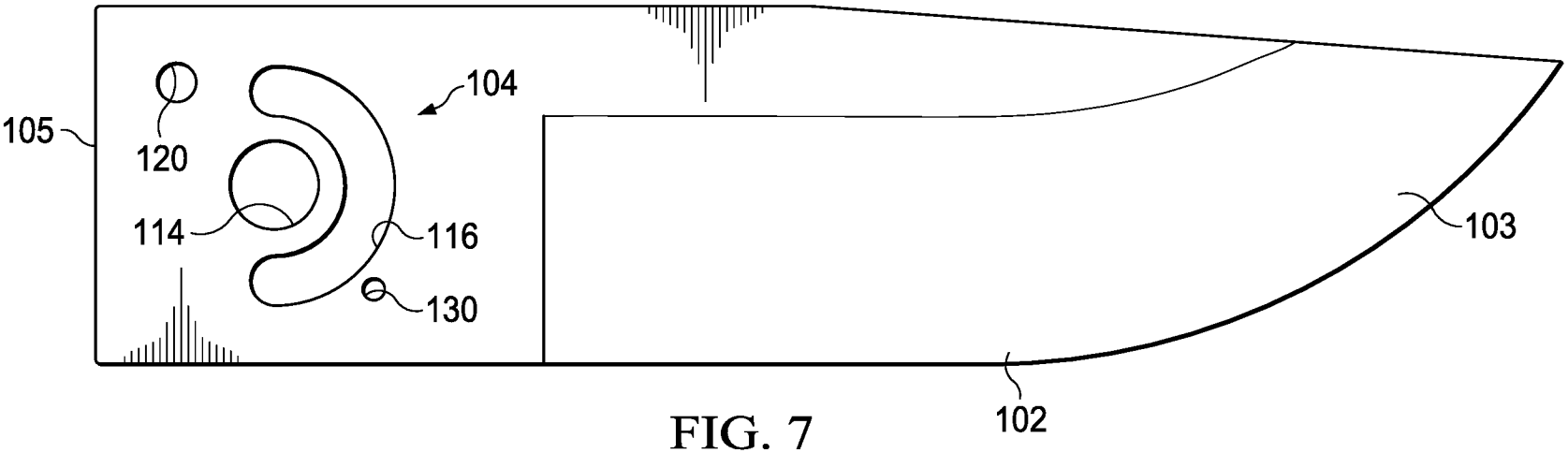
FIG. 7 is a side view of an embodiment of a knife blade of the knife depicted in FIG. 1 that incorporates an embodiment of the knife blade locking mechanism.

Referring now to FIG. 7, a side view of an embodiment of a knife blade (102) of the knife depicted in FIG. 1 that incorporates an embodiment of the knife blade locking mechanism is shown. In one embodiment, the increased diameter detent indentation (120) (or aperture in alternate embodiments) is formed on a top side of a proximal portion of the blade adjacent to the pivot aperture (114). In one embodiment, the decreased diameter detent indentation (130) (or aperture in alternate embodiments) is formed on a bottom side of a proximal portion of the blade. It is contemplated that in alternate embodiments of knives incorporating the knife locking mechanism described herein, that decreased diameter detent indentations/aperture and increased diameter detent indentations/aperture may be positioned at locations on the knife blade differing from what is depicted in the FIG.s shown herein. The locations at which the detent indentations/apertures are formed in alternate embodiments will depend on the positioning of the detent elements in the knife and thus can vary significantly. Thus, while the detent elements and detent release shafts are generally depicted in the figures as being positioned adjacent to the top side of the knife, alternate embodiments of knives utilizing the knife locking mechanism taught herein may include detent elements and correspondingly aligned detent release shafts (and slots, springs, etc.) positioned at other locations further away from the top side of the knife. Also, as discussed above, the precise dimensions of the diameters of the detent indentations/apertures formed on the knife blade may vary amongst alternate embodiments, depending on factors such as the size of the knife blade, the size of the detent elements, the desired depth of engagement of the detent elements into such detent indentations/apertures.

Referring now to FIG. 8, a top exploded view of the embodiment of the knife (101) depicted in FIG. 1, having the knife blade (102) in the fully open position is shown. The reader can recognize from FIG. 8 that the components of the knife locking mechanism of the opposing lateral side of the knife are identical. In the fully open position as shown in FIG. 8, the interior surfaces of the respective detent elements (122, 123) are mated to their respective increased diameter detent indentations (120) formed on opposing sides of the knife blade. The respective detent release shafts are distally positioned such that the tapered interior side of the detent release shafts (124, 125) are wedged between their respective exterior surfaces of the detent elements and the interior surfaces of their respective detent housing covers, thereby preventing disengagement of the detent elements from the knife blade and causing the arrest of rotational movement of the blade. A slot (140) is formed in the handle scale (108) to capture the sliding movement of the spring-loaded detent release shaft (125). A hole or notch or recess (146) matching the size of the detent element is formed in the handle scale (108) between the blade and the detent release shaft, allowing for movement of the detent element (123) into such hole or notch or recess when the detent element is not mated with the increased diameter detent indentation or aperture. In one embodiment, the recess (146) is sized to receive over half of the detent element.

Referring now to FIG. 9, a top view of the embodiment of the knife (101) depicted in FIG. 1, having the knife blade (102) in the fully open position, with internal components or structures of the knife blade locking mechanism obscured by the knife handles or knife blade depicted using broken lines is shown. In the fully open position as shown in FIG. 9, the interior surfaces of the respective detent elements (122, 123) are mated to their respective increased diameter detent indentations (120) formed on opposing sides of the knife blade. The respective detent release shafts are distally positioned such that the tapered interior side of the detent release shafts (124, 125) are wedged between their respective exterior surfaces of the detent elements and the interior surfaces of their respective detent housing covers, thereby preventing disengagement of the detent elements from the knife blade and causing the arrest of rotational movement of the blade.

Referring now to FIG. 10, a top view of the embodiment of the knife (101) depicted in FIG. 1, having the knife blade in a partially closed position, with internal components or structures of the knife blade locking mechanism obscured by the knife handles or knife blade depicted using broken lines is shown. The user can utilize the detent actuator buttons (129, 128) to unlock the blade, sliding them in a proximal direction, the detent release shafts (124, 125) are also moved proximally such that they disengage the detent release shafts from being wedged between the exterior surfaces of the respective detent elements on both sides of the knife blades and the corresponding detent housing covers (132), which in turn permits the de-mating of the detent elements from the respective increased diameter detent indentations formed on the knife blade, the detent elements then being free to move in their matching size hole/notch/recess between the blade and the detent release shaft, allowing the blade to easily push the detent elements out of the way, thereby unlocking the blade and allowing for rotational movement back towards the closed blade position. In one embodiment, as the blade rotates towards the closed position, the detent element on each side of the blade maintains constant pressure on the blade as the ball nose end (156) of each detent release shaft is putting constant pressure on each detent element from the distally directed spring pressure on each detent release shaft. This minimal pressure imparted on the detent element by the ball nose of the detent release shaft allows for a controlled closing speed of the blade and allows the detent elements to be pushed into the decreased diameter detent indentation when fully closed and held there.

Figure 11:
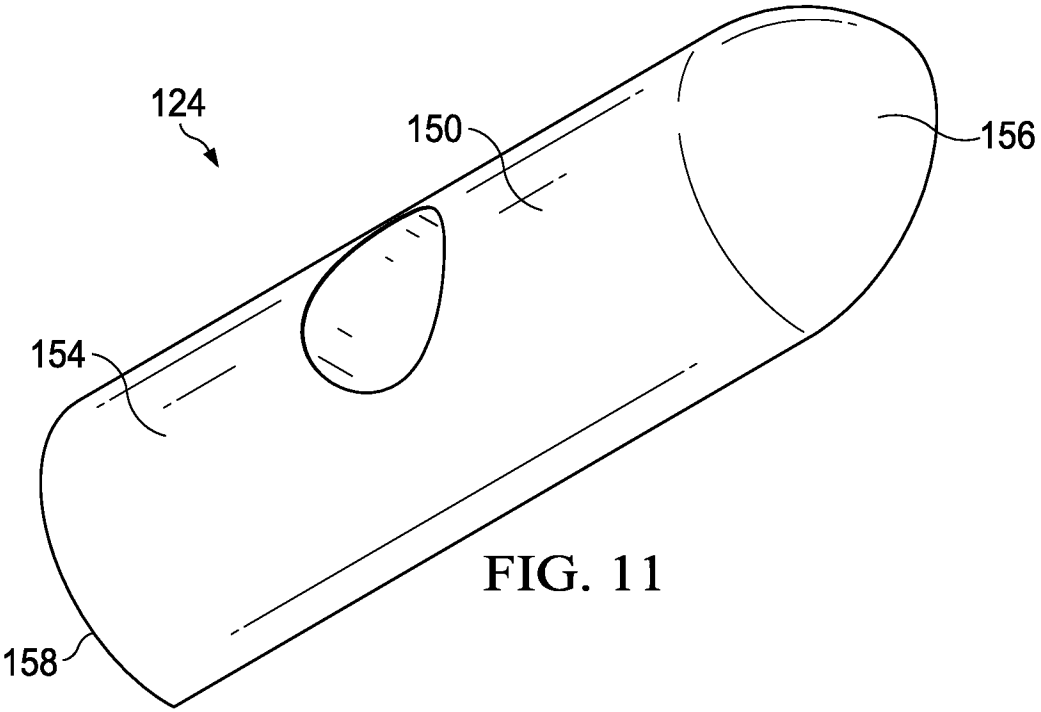
FIG. 11 is a perspective view of an interior side of an embodiment of a detent release shaft having a rounded interior side (side facing blade) having a distally located ball nose, said interior side being tapered so as to increase in thickness from the ball nose to approximately a middle point of the length of the detent release shaft.

Referring now to FIG. 11, a perspective view of an interior side (154) of an embodiment of a detent release shaft (124) having a tapered interior side for wedging between an exterior side of a rounded detent element and interior side of a detent housing cover is shown. In one embodiment, the tapered interior side of the detent release shaft is shaped and sized to wedge between a correspondingly shaped and sized detent element and the interior side of the detent housing cover. The profile of the tapered interior side of the detent release shaft may be selected on the basis of factors such as the size of the detent element and the desired degree of engagement between the detent release shaft and the detent element. In one embodiment of the detent release shaft, a ball nose (156) located on the distal end of the detent release shaft (124) is rounded on the interior side (154) of the shaft, the interior side of the detent release shaft being gradually tapered such that the thickness of the detent release shaft increases from the ball nose to approximately a midpoint of the length of the detent release shaft. The rounded ball nose of the detent release shaft is configured to engage the exterior side of the detent element as the detent release shaft slides in a distal direction, ultimately providing the interior directed force applied to the detent element against the knife blade until the detent release shaft slides distally to the extent that the tapered interior side of the detent release shaft engages the detent element and creates the wedging action.

Figure 12:
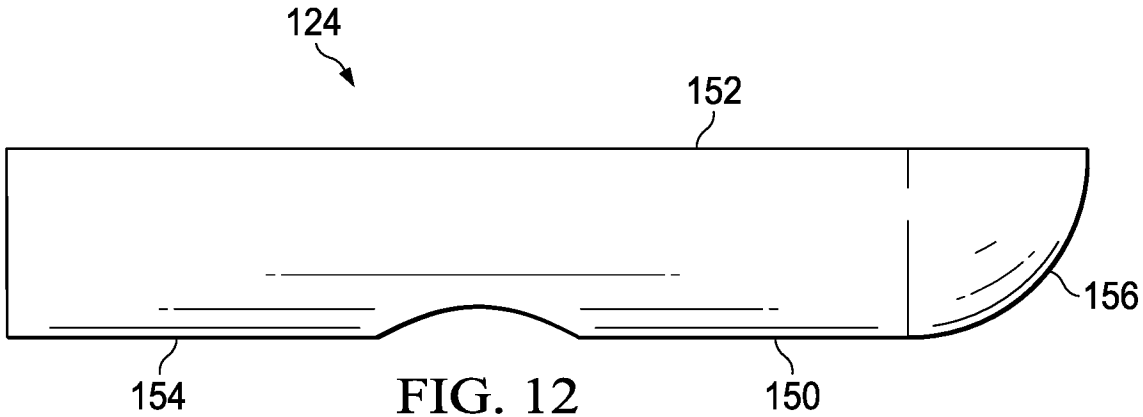
FIG. 12 is a side view of the embodiment of a detent release shaft depicted in FIG. 11, showing the rounded interior side and a flat exterior side, which together provide a wedging force imparted on the detent element.

Referring now to FIG. 12, a side view of the embodiment of a detent release shaft (124) depicted in FIG. 11 is shown. In one embodiment, the exterior side (152) of the detent release shaft (124) is substantially flat. In one embodiment, a threaded aperture (not visible in FIG. 12) is formed through the shaft. As noted above the threaded aperture in one embodiment is configured to receive a correspondingly threaded shaft of the detent actuator button.

Figure 13:
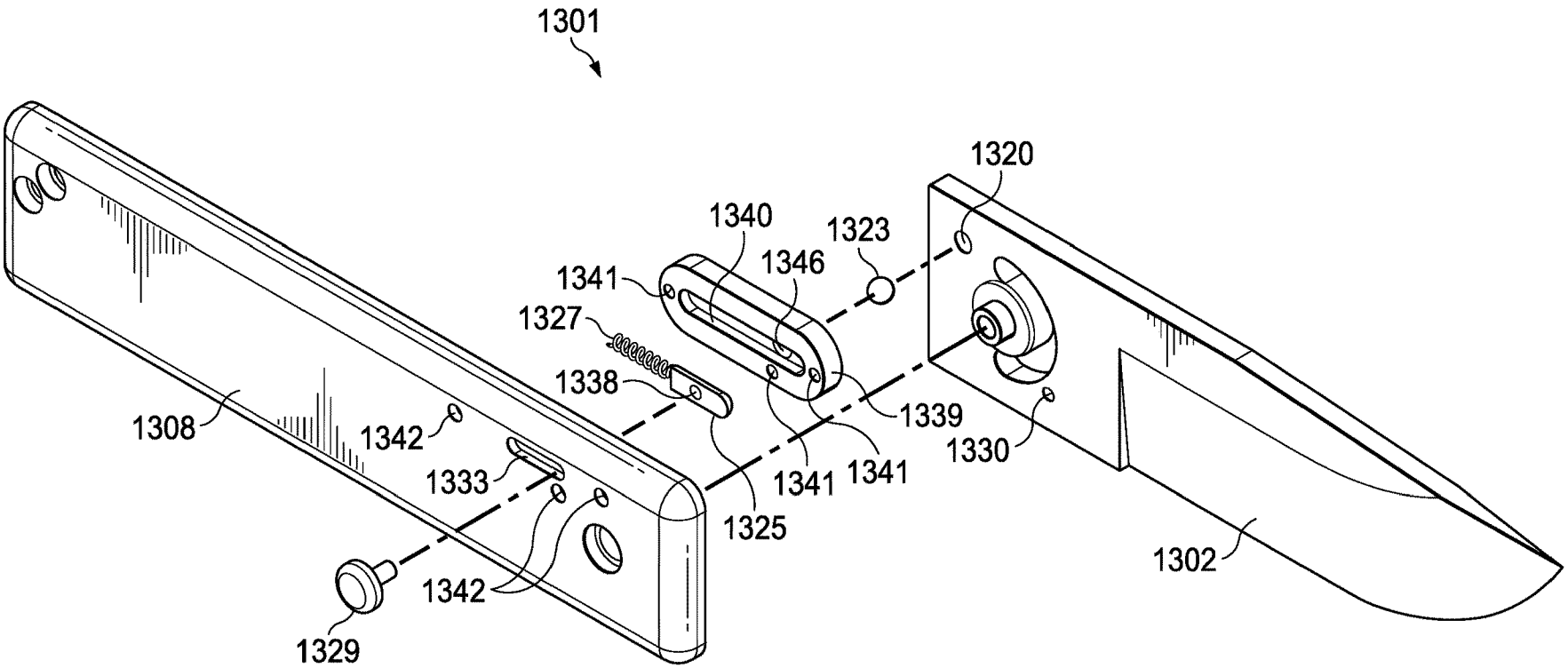
FIG. 13 is an exploded view of one side of an alternate embodiment of a knife utilizing a double-sided ball slide knife blade locking mechanism.

Referring now to FIG. 13, an exploded view of one side of an alternate embodiment of a knife utilizing a double-sided ball slide knife blade locking mechanism is shown. Only the handle scale and other components of the knife found on one side of the knife are depicted in FIG. 13 for the purposes of depicting how in this alternate embodiment of the knife, a drop-in cartridge housing (1339) may be utilized to simplify mass production of the knife, and provide for further options of materials used to construct the knife. In this alternate embodiment of the knife depicted in FIG. 13, an elongated cartridge housing (1339) has a channel (1340) formed on an exterior side thereof, said channel (1340) sized to receive a correspondingly sized detent release shaft (1325) and spring (1327). The detent release shaft (1325) is configured to slide within the channel (1340) in a distal and proximal direction. A hole (1346) is formed through an interior side of the cartridge housing, said hole (1346) being sized and shaped to receive a detent element (1323), and permit the detent release shaft (1325) to contact said detent element (1323). Apertures (1341) formed in the cartridge housing may be aligned with apertures (1342) formed in the handle scale (1308) such that one or more fasteners such as screws may be used to secure the cartridge to the interior side of the handle scale. It should be noted however, that in further alternate embodiments, the cartridge housing may be secured to the interior side of the handle scale by utilizing other means such as, for example, adhesives.

Still referring to FIG. 13, an elongated slot (1333) is formed on the exterior side of the handle scale (1308). The shaft of a detent actuator button (1329) is configured to slide through the slot (1333) and be fastened to the detent release shaft (1325) at a threaded hole (1338). Using the detent actuator button, a user may slide the detent release shaft in a proximal and distal direction in the manner which has been previously described above. However, unlike in the embodiments discussed above, the handle scale of the alternate embodiment of the knife depicted in FIG. 13 does not include the slot (140) or recess/notch (146) formed on the handle scale as depicted in FIG. 8, as such structures are found in the cartridge housing, thereby simplifying the process of manufacturing the handle scales. Moreover, in this alternate embodiment, rather than utilizing a cover plate on the exterior side of the handle scale, the scale itself serves as the cover. A further advantage of this alternate configuration is that the cartridge housing, and lack of a cover plate, results in a cleaner external appearance of the knife.

Figure 14:
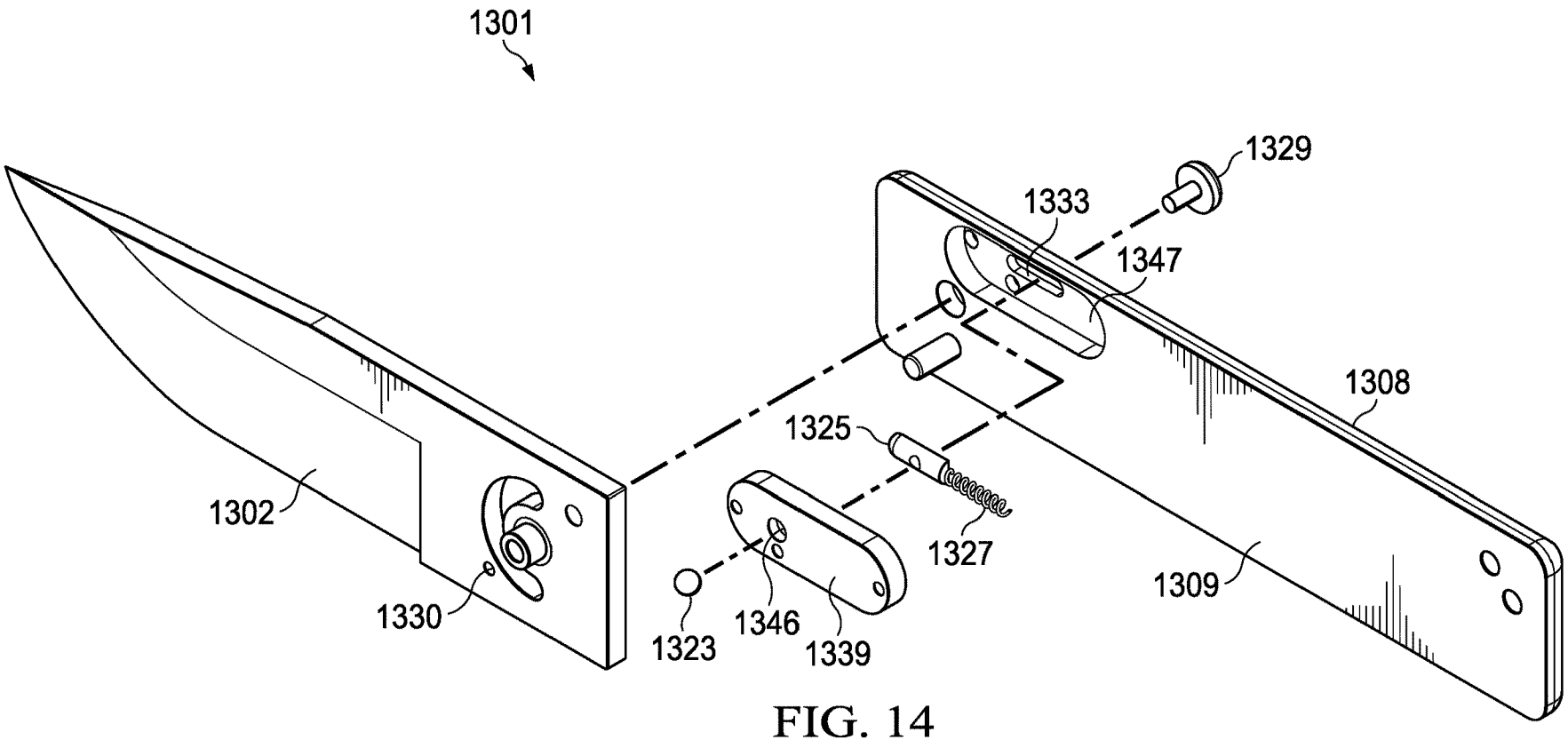
FIG. 14 is an exploded view of the alternate embodiment of a knife utilizing a double-sided ball slide knife blade locking mechanism shown in FIG. 13, as viewed from an opposite vantage point depicted in FIG. 13.

Now referring to FIG. 14, shown is an exploded view of the alternate embodiment of a knife utilizing a double-sided ball slide knife blade locking mechanism shown in FIG. 13, as viewed from an opposite vantage point depicted in FIG. 13. An elongated recess (1347) is formed on the interior side (1309) of the handle scale (1308), said recess being shaped and sized to receive a correspondingly shaped and sized cartridge housing (1339). The interior side of the cartridge housing (1339), which is shown in FIG. 14, has an opening into the aforementioned hole (1346) for receiving the detent element (1323). In a manner generally similar to that which has been described above in connection with the other embodiments, the detent element (1323) is configured to travel at least partially into the hole (1346) formed in the cartridge housing (1339), the hole (1346) also permitting the interior side of the detent release shaft to contact such detent element to arrest movement of the blade in the manner described above. A further advantage of utilizing the cartridge housing as depicted in the alternate embodiment of the knife shown in FIG. 13 and FIG. 14 is that it provides greater latitude in the types of materials used to construct the handle scales. For example, the cartridge housing could be constructed out of hardened steel, which would tend to increase the tightness of the detent element in the blade for a longer duration of time, while allowing for the use of less rigid materials to be used to construct the handle scale (for example, carbon fiber or G-10 high-pressure fiberglass laminate).

In one embodiment, a folding knife having a blade locking mechanism is disclosed herein, said folding knife comprising a handle having a first handle scale and a second handle scale; a blade pivotally coupled to said handle about a pivot aperture at a proximal portion of said blade, said blade having a first detent aperture formed through said proximal portion of said blade, said blade having a second detent aperture formed through said proximal portion of said blade; a first spring-loaded shaft slidably mounted within said first handle scale and configured to engage a first detent ball positioned intermediate said first handle scale and said blade; and a second spring-loaded shaft slidably mounted within said second handle scale and configured to engage a second detent ball positioned intermediate said second handle scale and said blade. In one embodiment, the folding knife is further configured wherein said first detent aperture has first opposing openings formed on opposing lateral sides of said blade, wherein said second detent aperture has second opposing openings formed on said opposing lateral sides of said blade, and wherein said first opposing openings are larger than said second opposing openings. In one embodiment, the folding knife is further configured wherein when said blade is in an open position, said first detent ball and said second detent ball are configured to mate with respective said first opposing openings of said first detent aperture to arrest pivotal movement of said blade. In one embodiment, the folding knife is further configured wherein when said blade is in a closed position, said first detent ball and said second detent ball are configured to mate with respective said second opposing openings of said second detent aperture to resist pivotal movement of said blade. In one embodiment, the folding knife further comprises a first lever attached to an exterior side of said first spring-loaded shaft; and a second lever attached to an exterior side of said second spring-loaded shaft; wherein each of first lever and second lever is configured to allow a user of said folding knife to slide said first spring-loaded shaft and said second spring-loaded shaft, respectively, in a distal direction and proximal direction. In one embodiment, the folding knife is further configured wherein when said blade is in an open position and said first spring-loaded shaft slides in said distal direction, an interior side of said first spring-loaded shaft prevents said first detent ball from de-mating from said first detent aperture, and wherein where said blade is in an open position and said second spring-loaded shaft slides in said distal direction, an interior side of said second spring-loaded shaft prevents said second detent ball from de-mating from said first detent aperture. In one embodiment, the folding knife is further configured wherein said first spring-loaded shaft is slidably mounted within a first elongated slot formed in said first handle scale, and wherein said second spring-loaded shaft is slidably mounted within a second elongated slot formed in said second handle scale. In one embodiment, the folding knife is further configured wherein a first spring is mounted within a proximal portion of said first elongated slot and is configured to impart a distally directed spring force on said first spring-loaded shaft, and wherein a second spring is mounted within a proximal portion of said second elongated slot and is configured to impart a distally directed spring force on said second spring-loaded shaft. In one embodiment, the folding knife is further configured wherein an interior side of said first spring-loaded shaft is tapered in increasing thickness along at least a portion of a length of said first spring-loaded shaft. In one embodiment, the folding knife is further configured wherein an exterior side of said first spring-loaded shaft has a flat surface.

In one embodiment, a folding knife having a blade locking mechanism is disclosed herein, said folding knife comprising a handle having a first handle scale and a second handle scale; a blade pivotally coupled to said handle about a pivot aperture, said blade having a first lateral side and a second lateral side, said blade having a first circular detent indentation formed on a proximal portion of said first lateral side of said blade, said blade having a second circular detent indentation formed on a proximal portion of said second lateral side of said blade, said blade having a third circular detent indentation formed on a proximal portion of said first lateral side of said blade, said blade having a fourth circular detent indentation formed on a proximal portion of said second lateral side of said blade, said first detent indentation and said second detent indentation each being larger in diameter than said third detent indentation said fourth detent indentation; a first detent ball positioned intermediate said proximal portion of said first lateral side of said blade and an interior side of said first handle scale; a second detent ball positioned intermediate a proximal portion of said first lateral side of said blade and an interior side of said first handle scale; a first spring-loaded shaft having a first tapered interior side thereof, said first tapered interior side of said first spring-loaded shaft configured to wedge between an exterior side of said first detent ball and a first housing cover attached to said first handle scale, said first spring-loaded shaft configured to mount and slide within a first slot formed within said first handle scale, a first lever being attached to an exterior side of said first spring-loaded shaft; and a second spring-loaded shaft having a second tapered interior side thereof, said second tapered interior side of said second spring-loaded shaft configured to wedge between an exterior side of said second detent ball and a second housing cover attached to said second handle scale, said second spring-loaded shaft configured to mount and slide within a second slot formed within said second handle scale, a second lever being attached to an exterior side of said second spring-loaded shaft, wherein when said blade of said folding knife is in an open position, an interior side of said first detent ball is configured to mate with said first circular detent indentation to arrest rotational movement of said knife blade, and an interior side of said second detent ball is configured to mate with said second circular detent indentation to arrest rotational movement of said knife blade. In another embodiment, when said blade of said folding knife is in a closed position, an interior side of said first detent ball is configured to mate with said third circular detent indentation to resist rotational movement of said knife blade, and an interior side of said second detent ball is configured to mate with said fourth circular detent indentation to resist rotational movement of said knife blade.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes that come within the meaning and range of equivalency of the claims are embraced therein. Further, the recitation of method steps does not denote a particular sequence for execution of the steps. Such method steps may therefore be performed in a sequence other than that recited unless the particular claim expressly states otherwise.

I claim:

1. A folding knife comprising:

a handle having a first handle scale and a second handle scale;

a blade pivotally coupled to said handle about a pivot aperture at a proximal portion of said blade, said blade having a first detent aperture formed through said proximal portion of said blade, said blade having a second detent aperture formed through said proximal portion of said blade;

a first spring-loaded shaft slidably mounted within said first handle scale and configured to engage a first detent ball positioned intermediate said first handle scale and said blade; and a second spring-loaded shaft slidably mounted within said second handle scale and configured to engage a second detent ball positioned intermediate said second handle scale and said blade.

2. The folding knife of claim 1, wherein said first detent aperture has first opposing openings formed on opposing lateral sides of said blade, wherein said second detent aperture has second opposing openings formed on said opposing lateral sides of said blade, and wherein said first opposing openings are larger than said second opposing openings.

3. The folding knife of claim 2, wherein when said blade is in an open position, said first detent ball and said second detent ball are configured to mate with respective said first opposing openings of said first detent aperture to arrest pivotal movement of said blade.

4. The folding knife of claim 2, wherein when said blade is in a closed position, said first detent ball and said second detent ball are configured to mate with respective said second opposing openings of said second detent aperture to resist pivotal movement of said blade.

5. The folding knife of claim 1, further comprising a first lever attached to an exterior side of said first spring-loaded shaft; and a second lever attached to an exterior side of said second spring-loaded shaft; wherein each of the first lever and the second lever is configured to allow a user of said folding knife to slide said first spring-loaded shaft and said second spring-loaded shaft, respectively, in a distal direction and a proximal direction.

6. The folding knife of claim 5, wherein when said blade is in an open position and said first spring-loaded shaft slides in said distal direction, an interior side of said first spring-loaded shaft prevents said first detent ball from disengaging with said first detent aperture, and wherein when said blade is in an open position and said second spring-loaded shaft slides in said distal direction, an interior side of said second spring-loaded shaft prevents said second detent ball from disengaging with said first detent aperture.

7. The folding knife of claim 1, wherein said first spring-loaded shaft is slidably mounted within a first elongated slot formed in said first handle scale, and wherein said second spring-loaded shaft is slidably mounted within a second elongated slot formed in said second handle scale.

8. The folding knife of claim 7, wherein a first spring is mounted within a proximal portion of said first elongated slot and is configured to impart a distally directed spring force on said first spring-loaded shaft, and wherein a second spring is mounted within a proximal portion of said second elongated slot and is configured to impart a distally directed spring force on said second spring-loaded shaft.

9. The folding knife of claim 1, wherein an interior side of said first spring-loaded shaft is tapered in increasing thickness along at least a portion of a length of said first spring-loaded shaft.

10. The folding knife of claim 9, wherein an exterior side of said first spring-loaded shaft has a flat surface.

11. A folding knife comprising:

a handle having a first handle scale and a second handle scale;

a blade pivotally coupled to said handle about a pivot aperture, said blade having a first lateral side and a second lateral side, said blade having a first circular detent indentation formed on a proximal portion of said first lateral side of said blade, said blade having a second circular detent indentation formed on a proximal portion of said second lateral side of said blade, said blade having a third circular detent indentation formed on said proximal portion of said first lateral side of said blade, said blade having a fourth circular detent indentation formed on said proximal portion of said second lateral side of said blade, said first detent indentation and said second detent indentation each being larger in diameter than said third detent indentation and said fourth detent indentation;

a first detent ball positioned intermediate said proximal portion of said first lateral side of said blade and an interior side of said first handle scale;

a second detent ball positioned intermediate said proximal portion of said second lateral side of said blade and an interior side of said second handle scale;

a first spring-loaded shaft having a first tapered interior side thereof, said first tapered interior side of said first spring-loaded shaft configured to wedge between an exterior side of said first detent ball and a first housing cover attached to said first handle scale, said first spring-loaded shaft configured to mount and slide within a first slot formed within said first handle scale, a first lever being attached to an exterior side of said first spring-loaded shaft; and a second spring-loaded shaft having a second tapered interior side thereof, said second tapered interior side of said second spring-loaded shaft configured to wedge between an exterior side of said second detent ball and a second housing cover attached to said second handle scale, said second spring-loaded shaft configured to mount and slide within a second slot formed within said second handle scale, a second lever being attached to an exterior side of said second spring-loaded shaft, wherein when said blade of said folding knife is in an open position, an interior side of said first detent ball is configured to mate with said first circular detent indentation to arrest rotational movement of said blade, and an interior side of said second detent ball is configured to mate with said second circular detent indentation to arrest rotational movement of said blade.

12. The folding knife of claim 11, wherein when said blade of said folding knife is in a closed position, said interior side of said first detent ball is configured to mate with said third circular detent indentation to resist rotational movement of said blade, and said interior side of said second detent ball is configured to mate with said fourth circular detent indentation to resist rotational movement of said blade.

13. The folding knife of claim 11, wherein a distal end of said first spring-loaded shaft is ball nosed, and wherein said first tapered interior side of said first spring-loaded shaft is tapered in increasing thickness from said ball nose to a midpoint of a length of said first spring-loaded shaft.

14. The folding knife of claim 11, wherein said first detent ball and said second detent ball each comprise a ball bearing constructed of metal.

15. The folding knife of claim 11, wherein said first housing cover is formed on an exterior side of said first handle scale, said first housing cover has a third slot configured to receive a portion of said first lever.

16. The folding knife of claim 11, wherein a first spring is proximally mounted within said first slot with said first spring-loaded shaft.

17. The folding knife of claim 11, wherein said exterior side of said first spring-loaded shaft has a flat surface.

18. A folding knife comprising:

a handle having a first handle scale and a second handle scale;

a blade pivotally coupled to said handle about a pivot aperture at a proximal portion of said blade, said blade having a first detent indentation formed on said proximal portion of said blade, said blade having a second detent indentation formed on said proximal portion of said blade;

a first spring-loaded shaft slidably mounted within said first handle scale and configured to engage a first detent ball positioned intermediate said first handle scale and said blade; and a second spring-loaded shaft slidably mounted within said second handle scale and configured to engage a second detent ball positioned intermediate said second handle scale and said blade.

19. The folding knife of claim 18, further comprising a cartridge that is configured to be inserted into a slot formed on an interior side of said first handle scale, and wherein a recess is formed on an interior side of said cartridge.

20. The folding knife of claim 18, wherein said first detent indentation is larger than said second detent indentation.

* * * * *